United States Patent [19]

Henderson

[11] 4,269,049

[45] May 26, 1981

[54] WHEEL LOCK

[76] Inventor: George H. Henderson, 1098 Meadow Dr., Lennon, Mich. 48449

[21] Appl. No.: 926,494

[22] Filed: Jul. 20, 1978

[51] Int. Cl.[3] ..... E05B 71/00; E05B 73/00

[52] U.S. Cl. ..... 70/227; 70/18; 70/234; 211/5; 211/20; 292/216

[58] Field of Search ..... 70/226, 227, 234, 235, 70/233, 18, 62, 14; 211/5, 17–20; 292/216, 45, 106, 207, 198

[56] References Cited

U.S. PATENT DOCUMENTS

| | | | |
|---|---|---|---|
| 611,401 | 9/1898 | White | 70/234 |
| 631,665 | 8/1899 | Potter | 211/5 |
| 633,806 | 9/1899 | Cifka | 211/17 |
| 634,441 | 10/1899 | Capen et al. | 70/234 |
| 977,228 | 11/1910 | Schestopol | 70/18 |
| 1,168,234 | 1/1916 | Tausch | 292/216 |
| 1,376,114 | 4/1921 | Raney | 70/18 |
| 1,379,423 | 5/1921 | Trimm | 70/18 |
| 3,857,504 | 12/1974 | Bausenbach et al. | 292/216 X |

FOREIGN PATENT DOCUMENTS

| | | | |
|---|---|---|---|
| 67663 | 9/1948 | Denmark | 211/5 |
| 602424 | 12/1925 | France | 70/234 |
| 600584 | 12/1959 | Italy | 70/227 |
| 1321834 | 7/1973 | United Kingdom | 292/216 |

*Primary Examiner*—James T. McCall
*Assistant Examiner*—Carl F. Pietruszka

[57] ABSTRACT

A locking mechanism for effectuating locking of a wheel includes at least one rotatable arcuate jaw which is in opposition to an opposed jaw. Contact by the wheel with the rotatable jaw causes the rotation thereof into mating interengagement with the opposed jaw. The mating interengagement causes the jaws to envelope or encircle the wheel thereby locking the wheel in place.

3 Claims, 6 Drawing Figures

WHEEL LOCK

BACKGROUND OF THE INVENTION

1. Field of the Invention

The present invention pertains to locking mechanisms. More particularly, the present invention concerns locking mechanisms for locking a wheel in place. Even more particularly, the present invention concerns locking mechanisms for locking bicycle wheels in place.

2. Prior Art

Normally, in locking wheels, such as bicycle wheels or the like, a chain or similar type device is wrapped around the wheel or tire thereof. Thereafter, a lock, such as a key operated or combination lock has its arcuate section inserted through opposite ends of the chain. Such systems are, of course, well known. However, in shopping centers and other similar business locations such locking is not readily achieved. Ordinarily, there are no posts or the like in which to wrap the chain around in order to render it stationary or in position. Thus, there has been developed heretofore bicycle racks in which a plurality of slots are provided for accommodating therewithin the tire or wheel of the bicycle. However, it is difficult to lock a bicycle in position unless the rider carries his own chain.

Furthermore, in using such racks, it is to be duly noted that the actual emplacement of the wheel therewithin requires a demounting and an actual placement of the wheel in the slot provided therefor.

The present invention, on the other hand, provides a lock for a wheel which envelopes or encircles the wheel upon contact between the wheel and the device, per se. Furthermore, the present invention provides a ramp in association therewith whereby the locking is effectuated upon contact with the wheel merely going up the ramp. Thus, there is elimination of the requirement of demounting from the bicycle.

Thus, the present invention provides a new stand or rack assembly, as well as a locking means therefor.

STATEMENT OF PRIOR ART

To the best of applicant's knowledge, the most closely related art is found in the following United States Patents:

U.S. Pat. Nos. 2,010,707; 3,910,381; 3,785,500; 3,981,166; 1,688,496; 1,218,843; 3,805,564; 1,386,414; 3,762,569; 3,844,146.

The present invention is distinct therefrom in the assemblage of its elements and the deployment of the pivotally rotatable jaws upon engagement with the wheel of the bicycle.

SUMMARY OF THE INVENTION

In accordance with the present invention, there is provided a locking means or mechanism for a wheeled vehicle, such as a bicycle or the like. The locking mechanism hereof comprises a pair of opposed jaws, at least one of which is pivotally mounted and movable with respect to the other jaw. The jaws are provided with intermeshing gears for synchronization of the movement therebetween.

Upon the jaws being in abutting relationship and enveloping a wheel, a locking pin projects through the bases of the jaws to interlock same to thereby prevent release.

In one embodiment of the present invention, a combination or key-operated cylinder lock locks the locking pin or projecting pin in position to prevent the jaws from being released from one another.

In another embodiment of the present invention, the present locking mechanism is incorporated into a automotive vehicle to define a luggage rack and lock assembly.

For a more complete understanding of the present invention, reference is made to the following detailed description and accompanying drawing.

In the drawing, like reference characters refer to like parts throughout the several views in which:

DESCRIPTION OF THE PREFERRED EMBODIMENTS

Figure 1:
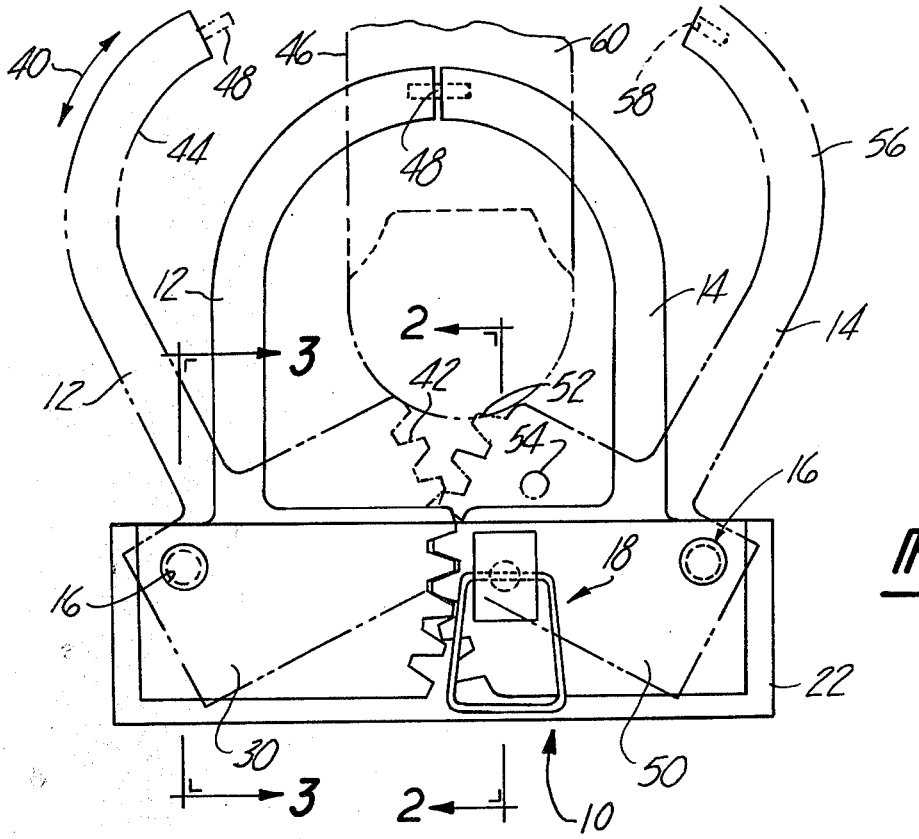
FIG. 1 is a plan view, partly in phantom, of a locking mechanism in accordance with the present invention.
Figure 2:
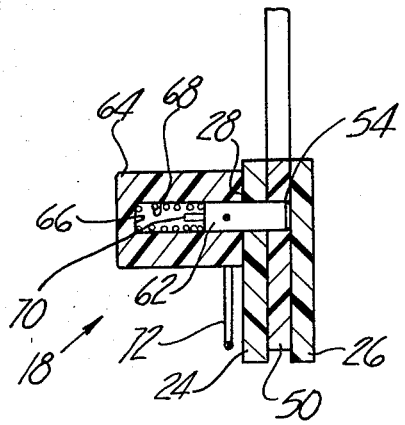
FIG. 2 is a cross-sectional view taken along line 2—2 of FIG. 1.
Figure 3:
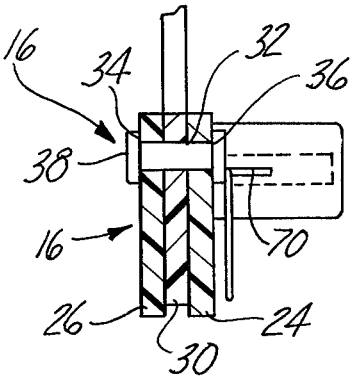
FIG. 3 is a cross-sectional view taken line 3—3 of FIG. 1.

Now, and with reference to the drawing, and in particular, FIGS. 1–3, there is depicted a first embodiment of the present invention, generally, denoted at 10. The locking mechanism 10 hereof generally comprises a pair of opposed jaws, 12, 14. The present invention further comprises means 16 for rendering at least one of the jaws 12 or 14 pivotally rotatable toward the opposed or opposite jaw. The present invention, also, comprises a locking pin or projecting pin generally denoted at 18 for interlocking the opposed jaws when in closed or locking mode.

At the outset, it should be noted that the present invention contemplates the provision of at least one jaw 12 or 14, which is pivotally rotatable towards an opposite jaw which may or may not be movable. Where one of the jaws is stationary, only the other jaw is mounted for pivotal rotation. However, for purposes of facilitating an understanding of the present invention, the ensuing description will be made with respect to a preferred embodiment wherein the jaws are both pivotally movable or rotatable.

Referring again to the drawing, and, in particular, to FIGS. 1–3 hereof, and with more particularity, the locking mechanism hereof comprises a base 22. The base comprises a shell-like structure which supports the jaws 12, 14 and which houses the locking pin 18. The base 22 comprises a pair of spaced apart walls 24, 26. One of the walls 24 or 26 has an aperture 28 provided therethrough. The locking pin assembly 18 projects therethrough to lock the jaws in interlocking engagement in a manner to be described subsequently.

The jaws 12, 14, as noted, are mounted for opposed rotation and cooperate with each other to move toward each other to encircle a wheel or the like. The jaw 12 comprises a base section 30 which is sandwiched between the walls 24, 26 of the base 22. The base portion projects above the upper terminus or edge of the walls 24, 26 for reasons which will be described subsequently. The base or bottom portion 30 is provided with an aperture 32. The aperture 32 registers with apertures or openings 34, 36 provided respectively in walls 26, 24. The openings 34 and 36 are in registry. Projecting through the apertures 32, 34 and 36 is a pivot pin 38. The pivot pin 38 cooperates with the openings to define the means 16 for mounting the jaw 12 for pivotal rotation. The pin 38 enables the jaw 12 to pivotally rotate about the axis thereof in the direction of the arrow 40. The radially inward edge of the base portion 30 is provided with a gear tooth configuration 42. The gear configuration meshes with a complementary configuration provided on the opposed jaw 14 for synchronization of movement therebetween, in a manner to be described subsequently.

Extending upwardly from the top of the base 30 is an arcuate leg 44. The arcuate leg 44 is adapted and configured to encircle a bicycle wheel 46 or the like. The upper or free end of the leg 44 is provided with a pin 48 projecting laterally outwardly therefrom. The pin is an alignment or guide pin 48. The guide pin 48 cooperates with a slot in the opposed jaw for inserting interengagement therebetween.

As heretofore noted, the opposed or opposite jaw 14 is in opposition of the jaw 12. The jaw 14 includes a base or bottom portion 50. The bottom portion 50 is analogous to the bottom portion or base 30 of the opposed jaw. The jaw 14 is pivotally mounted for rotation in the same manner heretofore described with reference to the jaw 12 via means 16. The radially inward edge of the base portion 50 is provided with the gear tooth assembly 52. The gear tooth assembly 52 meshes with the gear tooth assembly 42, as shown. An opening 54 is provided in the base 50. The opening 54 has the pin 18 projecting therethrough when the opposed jaws are in contact to thereby prevent unlocking rotation thereof in a manner to be described subsequently. The bottom or base plate 50 has its top edge projecting above the top edge of the walls 24, 26 analogously to that of the bottom or base plate 30 of the jaw 12. Extending upwardly from the top of the base 50 is an arcuate leg 56. The upper end of the leg 56 has an arc which projects toward the arc of the leg 44. The upper or free terminus of the leg 56 is provided with a slot or bore 58. The bore 58 receives the pin 48 upon closure or rotation of the jaws toward each other to the locking mode. Thus, as the jaws are rotated toward each other, the pin 48 projects into the slot 58 thereby guiding closure.

In order to lock the jaws together, a downward force is applied to the respective bases or base plates 30, 50 medially thereof. This downward force causes rotation of the base plates about the respective pivot means. The rotation, in turn, causes intermeshing between the gears or gear teeth 42, 52. Such downward force is applied by a bicycle tire 60 or the like, acting downwardly upon the base plates. The jaws 12, 14 have a predetermined height which enable clearance above the tire and into the spoked area of the tire wheel.

Closure of the jaws thereby locks the tire in position. In order to prevent unwanted opening of the jaws, means 18 is provided. The means 18 generally comprises a pin 62 which projects through openings 28 and 54 upon closure of the jaws and is biassed into this projected position.

More specifically, a housing 64 is secured to the base wall 24. The housing 64 includes an internal cavity or plenum 66. Disposed within the plenum is a biassing means, such as a spring 68 or the like. The pin 62 is mounted for axially sliding movement in response to the bias exerted by the biassing means or spring 68 which engages the pin at the base thereof, as shown. Thus, upon registration between the openings 28 and 54, which only occurs upon the jaws locked together, the bias exerted by the spring exerts a force against the pin 62 to project the pin into the openings. The presence of the pin in the openings precludes rotation of the jaws away from each other to, otherwise, unlock the jaws.

The housing has a transverse slot 70 formed therein. A clip 72 is secured to the pin 62. By manually grasping the clip and pulling out the pin therewith against the bias of the spring 68, a pin can be withdrawn from the apertures 28, 54 to thereby enable rotation of the jaws.

The embodiment shown in FIGS. 1–3 hereof detail the underlying principles of the present invention.

It is to be appreciated herefrom that, and as heretofore noted, only one jaw need be rotational mounted. However, and as heretofore noted, for purposes of symmetry the embodiment described herein is with respect to both jaws being rotationally mounted.

Figure 4:
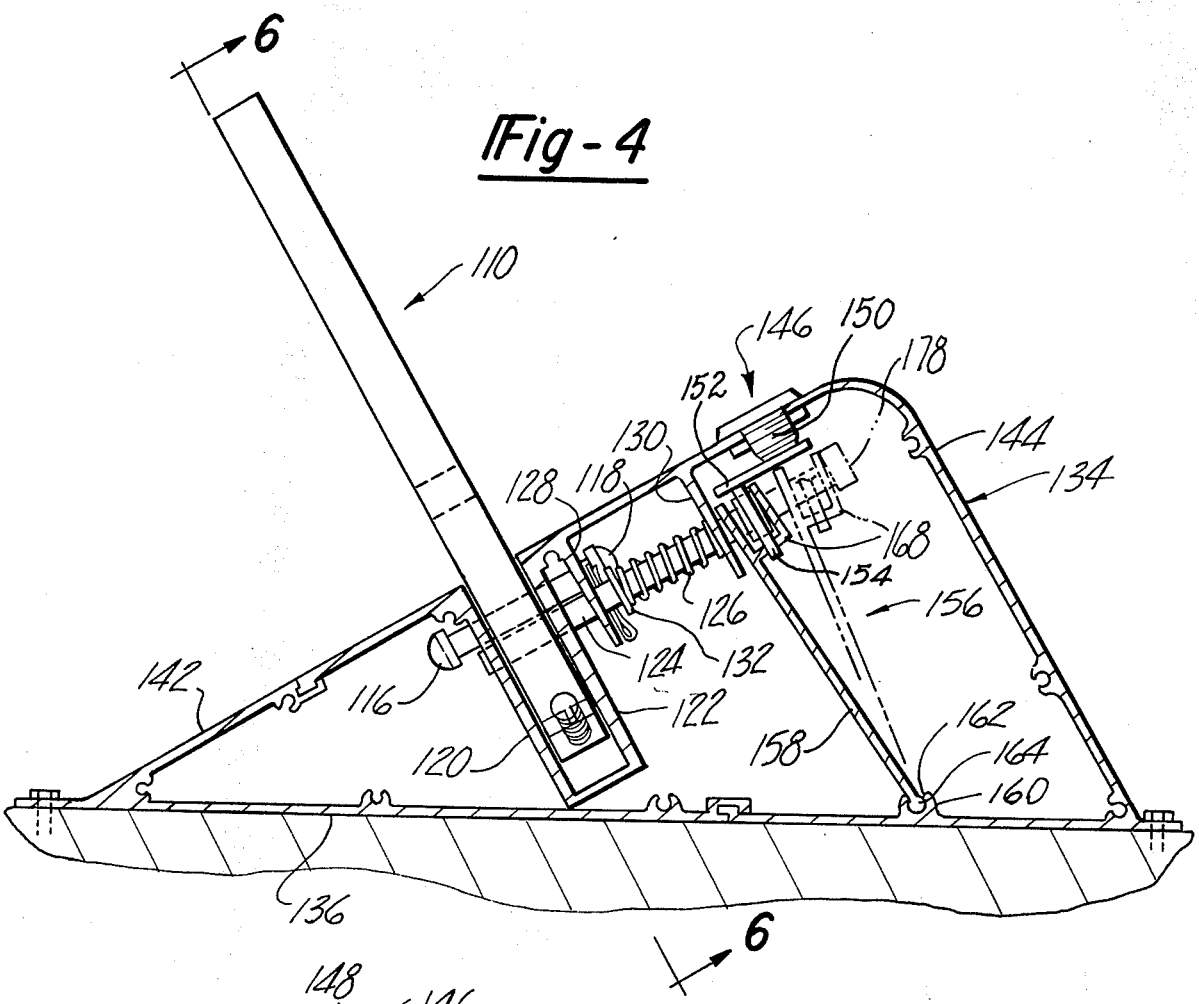
FIG. 4 is a side elevational view, partly in cross-section, of a second embodiment of the present invention.
Figure 5:
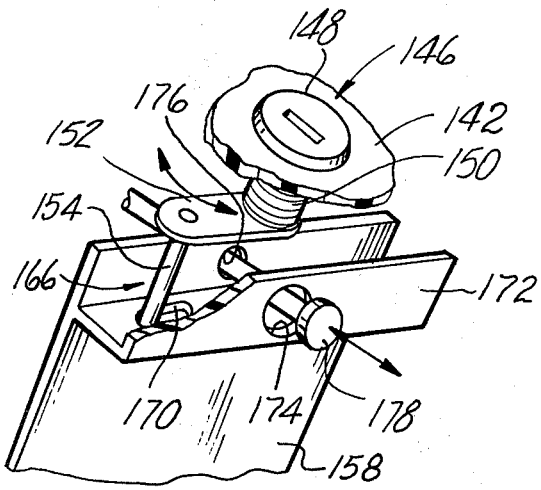
FIG. 5 is a cross-sectional view taken along line 5—5 of FIG. 4.
Figure 6:
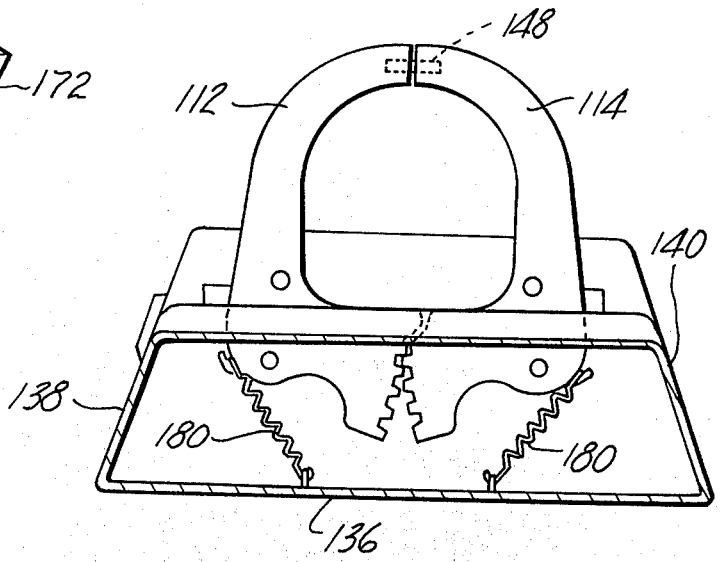
FIG. 6 is a cross-sectional view taken along line 6—6 of FIG. 4.

In FIGS. 4–6 hereof, there is depicted herein a further embodiment of the present invention. In accordance herewith, the projecting pin which prevents rotation is locked into position via a cylinder lock or the like. The import of this embodiment is that it enables a plurality of locking jaws to be assembled together to form a locking bike rack or the like. Thus, and with reference to FIGS. 4–6, there is depicted therein a further embodiment of the present invention.

In accordance herewith, the mode of operation of the jaws is the same as heretofore described. Thus, for purposes of clarity, the discussion, with respect to the actual rotation of the jaws and the mounting of same, will be minimized.

Now, and with reference to the drawing, and in particular, FIGS. 4–6, there is depicted a wheel lock in accordance with the present invention and, generally, denoted at 110. The wheel lock includes a pair of jaws 112, 114 mounted for pivotal rotation about pivot pins 116, 118, respectively. The jaws are mounted between plates 120, 122 in the same manner heretofore described. A projecting pin 124 is biased for projection between the apertures formed in the base plates of the jaws. Biassing means, such as a coil spring 126, is wrapped around the pin 124, as shown. The pin is mounted and supported by brackets 128, 130. The brackets are spaced apart and have apertures formed therein through which the pin projects. The spring 126 is mounted between the brackets 128, 130 to thereby urge the pin toward the apertures formed in the base plates. The pin, also, includes an enlarged annular rim 132, which defines a seat for the spring 126. Thus, the spring is biassed and mounted between the rim 132 and the bracket 130, as shown. It is to be, thusly, appreciated that what has been described up to the point is the same as that described with the embodiment of FIGS. 1–3.

The lock hereof is disposed within a housing 134. The housing 134 comprises a base or bottom 136 which is a substantially planar member. The housing further comprises a pair of spaced apart, upstanding substantially parallel sidewalls 138, 140 respectively. The sidewalls are integrally formed with the base and extend upwardly therefrom. The top wall of the housing is defined by a sloped or slanted ramp 142 which is inclined angularly upwardly from the forward end of the base 136. The housing is enclosed by a rear wall 144, which extends between the free end of the ramp and the base, as shown.

The top wall is angularly inclined in order to facilitate deployment of the present invention. Specifically, a bicycle tire or wheel is easily rolled up the ramp to thereby engage the jaws to effectuate closure.

In accordance with this embodiment of the present invention, there is provided an anti-theft mechanism to prevent or deter unwanted opening of the jaws. Therefore, and in accordance herewith, there is provided a locking mechanism, generally denoted at 146. The locking mechanism comprises a lock cylinder 148 which is mounted in the ramp or top wall 142 and depends downwardly therefrom into the interior of the housing 134. The lock, per se, can comprise any conventional type of locking system, such as a key-operated cylinder, combination lock or the like. In order to facilitate an understanding hereof, the present invention is described with reference to a conventional key-operated cylinder lock.

As is known to the skilled artisan, such conventional key-operated cylinder locks comprise a rotatably mounted plug cylinder axially mounted for rotation within a housing. Pin tumblers are pressed down by biassing means, such as springs, to engage holes in the cylinder, thereby preventing the cylinder from rotating. The key raises the tumblers against the bias and out of the holes provided in the cylinder to thereby permit rotation of the cylinder. It is to be understood that the construction of the lock, per se, is not critical to the present invention. Rather, any such conventional type lock can be utilized herein.

As shown in FIGS. 4 and 5, the free or intermost end of the cylinder 150 has secured thereto a plate member 152. The plate member is fixedly mounted onto the free or inner end of the plug and is rotatable therewith. A pin 154 is mounted to the plate 152 at the free end thereof. The pin 154, as will subsequently be detailed, operates a pin release mechanism for unlocking the jaws in response to the rotation of the key. The locking pin 154 is fixedly mounted to the plate and is, thus, rotatable therewith.

Extending upwardly from the base 136 is a pin release plate 156. The pin release plate 156 is operative, in response to rotation of the key cylinder, to release the pin 124 from the apertures provided in the bases of the jaws. In other words, the pin release plate serves to release the jaws from the locked mode.

The pin release plate 156 comprises an upstanding wall 158 having one end rotatably mounted in an embossment 160 formed integrally with the base or bottom wall 136. The embossment 160 comprises an annular elongated groove 162 which receives therewithin a bead 164 formed at the base of the wall 158.

Integrally formed with the wall 158 is an L-shaped member 166. The L-shaped member includes a first leg 168 which extends outwardly from the wall 158 and is substantially perpendicular thereto. The leg 168 has a slot or opening 170 formed therein. The pin 154 extends into and through the slot 170 to thereby interconnect the lock cylinder to the pin release plate 156.

The L-shaped member 166, also, comprises a second leg 172 which is disposed substantially perpendicular to the leg 168 and is integrally formed therewith. The leg 172 is substantially parallel to the plate or wall 158 and co-terminus therewith. The leg 172 has an enlarged opening 174 formed therein. The opening 174 is in registry with an opening 176 formed in the wall 158. The opening 174 is larger than the opening 176 for reasons which will be explained subsequently.

It is to be appreciated, and as shown in FIG. 4, that rotation of the cylinder 150 in a first direction causes the pin release mechanism to move away from the bracket 130.

Rotation of the cylinder in a second, opposite direction, causes the pin release wall or mechanism to approach the bracket 130, as shown in solid lines.

As heretofore noted, the openings 174, 176 have different sizes. As shown in FIG. 4 the pin 124 has an enlarged head 178. The head extends through the opening 176. The head 178 is larger than the opening 176 and, therefore, cannot extend therethrough. Thus, rotation of the member 156 in the first direction causes engagement between the wall 158 and the head 178 thereby, and against the force of the bias 126, to release the pin from the apertures to permit unlocking of the jaws.

Rotation of the assembly 156 in the second direction, would, ordinarily create a force against the head 178 by the leg 172. However, the opening 174 is larger than the head 178 of the pin. Thus, rotation of the cylinder in the second direction whereby the member 156 is returned to proximity with the bracket 130 still leaves the pin free to project into the holes formed in the base upon closure of the jaws. Thus, when the jaws are closed together, the pin projects through the opening 174 and into the position shown in solid lines in FIG. 4. The jaws can only be unlocked by rotation of the key.

It is to be appreciated that other means and methods for releasing the pin from the holes can be utilized herein. Furthermore, it is to be appreciated that by the practice of the present invention the locking mechanism is always predisposed toward a locked state.

Furthermore, because the space between the wall 158 and the leg 172 is extremely small, the pin cannot be picked. In practicing the present invention, and as heretofore noted, a plurality of the locking mechanisms hereof can be strung together to form a bicycle rack or the like.

Furthermore, the locking mechanism hereof can be integrated into a vehicle associated luggage rack or the like to enable safe transport of a bicycle, such as on the top of a car or the like.

It will be appreciated from the preceding that there has been described herein the wheel locking mechanism which enables safe and secure locking of the tire of the bicycle or similar type velocipede.

It should be further noted with respect hereto that other accoutrements can be incorporated hereinto. For example, a spoke deflector or the like can be mounted on top of the jaws to prevent breakage of the spokes of the bicycle tire or the like.

Furthermore, and as shown in FIG. 6 hereof, it is possible in accordance herewith to mount biassing means, such as springs 180 between the base or bottom wall 136 and the jaws 112, 114 to thereby ordinarily bias the jaws to the open or unlocked state.

It is to be appreciated that other modifications and alterations can be made to the present invention without detracting from the spirit and scope hereof. All such modifications are within the ambit and pervue of the present invention.

Having, thus, described the invention what is claimed is:

1. A wheel locking mechanism comprising:

(a) a pair of opposed jaws, adapted to matingly abut, the jaws being configured to encircle the wheel of a vehicle when in mating abutment;

(b) at least one pivot, the pivot mounting one jaw thereon such that at least one jaw is pivotally rotatable toward the other jaw;

(c) a housing, the jaws being mounted for pivotal rotation within the housing;

(d) first means for locking the pivotally rotatable jaw against rotation when the jaws are in mating abutment; said first locking means comprising:

1. a pair of spaced apart brackets disposed in the housing;
2. a locking pin supported by the brackets and projecting therethrough, and
3. means for biasing the locking pin toward the pivotal jaw;

(e) a release for releasing the first locking means from its locking position; and (f) a second locking means for locking the release in a first position, the first position maintaining the first locking means in locking position to prevent the jaw from rotating;

wherein the jaw has an aperture which receives the locking pin upon mating abutment of the jaws, the locking pin preventing rotation of the pivotal jaw when in the aperture, the second locking means preventing the first locking means from being removed from the aperture when in the first position;

said release comprising:

a wall rotatably mounted in the housing and connected to the second locking means and being responsive thereto, the wall engaging the locking pin, and wherein rotation of the second locking means to the first position causes the wall to approach one of the support brackets and rotation of the second locking means to a second position causes the wall to engage the locking pin to force it out of the aperture against the normal bias.

2. The wheel lock mechanism of claim 1 wherein:

(a) the second locking means comprises:

(1) a rotatable cylinder lock extending into the interior of the housing, (2) a mounting plate journalled onto the interior end of the cylinder lock and rotatable therewith, and (3) a pin fixed to the mounting plate at one end thereof and to the release at the other end thereof, such that the release moves in response to rotation of the cylinder lock.

3. The wheel lock mechanism of claim 1 wherein the housing comprises:

(a) a base, (b) a pair of spaced apart upstanding sidewalls, (c) an angularly inclined top wall defining a ramp, (d) an end wall extending between the top wall and the base, and wherein the jaws project from the housing upwardly through the ramp.

* * * * *